US006763211B2

(12) United States Patent
Yokoyama

(10) Patent No.: US 6,763,211 B2
(45) Date of Patent: Jul. 13, 2004

(54) VERTICAL PATH SHEET JAM RECOVERY IMAGE FORMING APPARATUS

(75) Inventor: Hiroshi Yokoyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 30 days.

(21) Appl. No.: 10/307,383

(22) Filed: Dec. 2, 2002

(65) Prior Publication Data

US 2003/0103779 A1 Jun. 5, 2003

(30) Foreign Application Priority Data

Nov. 30, 2001 (JP) ..... 2001-366524
Nov. 30, 2001 (JP) ..... 2001-366525

(51) Int. Cl.[7] ..... G03G 15/16

(52) U.S. Cl. ..... 399/122; 399/124; 399/307; 399/308; 399/309

(58) Field of Search ..... 399/122, 124, 399/302, 307, 308, 309, 397, 400

(56) References Cited

U.S. PATENT DOCUMENTS

| | | | | |
|---|---|---|---|---|
| 4,926,358 A | | 5/1990 | Tani et al. | |
| 5,300,996 A | | 4/1994 | Yokoyama et al. | |
| 5,517,281 A | | 5/1996 | Miyashiro et al. | |
| 5,579,098 A | | 11/1996 | Noguchi et al. | |
| 5,787,326 A | * | 7/1998 | Ogawa et al. | 399/124 |
| 5,832,354 A | | 11/1998 | Kouno et al. | |
| RE36,124 E | | 3/1999 | Yokoyama et al. | |
| 5,915,147 A | | 6/1999 | Kouno et al. | |
| 6,255,632 B1 | | 7/2001 | Yokoyama et al. | |
| 6,340,810 B2 | | 1/2002 | Yokoyama et al. | |

FOREIGN PATENT DOCUMENTS

| | | |
|---|---|---|
| EP | 1 132 902 | 9/2001 |
| JP | 60-204573 | 10/1985 |
| JP | 11-296050 | 10/1999 |
| JP | 2001-100576 | 4/2001 |
| JP | 2001-277580 | 10/2001 |

OTHER PUBLICATIONS

K. Mason, Research Disclosure, No. 327, p. 479, XP–000258675, "Optical Copier Using Backside Intermediate for Duplex", Jul. 1991.

* cited by examiner

*Primary Examiner*—Hoan Tran
(74) *Attorney, Agent, or Firm*—Oblon, Spivak, McClelland, Maier & Neustadt, P.C.

(57) ABSTRACT

A duplex image forming apparatus including a first image carrier configured to carry a first image, and a second image carrier configured to receive the first image. The first image is transferred to one side of a recording medium from the second image carrier, and a second image is formed on the first image carrier and transferred to the other side of the recording medium. Also included is a recording medium conveying device configured to vertically convey the recording medium to a fixing section along a vertical conveyance path at least starting from where the first and second images are transferred onto the recording medium, and a fixing device included in the fixing section configured to simultaneously fix the first and second images to respective sides of the recording medium. Further, the fixing device is released in conjunction with the recording medium conveying device when the recording medium conveying device is swung and released from the image forming apparatus body such that a portion of the vertical conveyance path extending upstream of the fixing device is opened.

14 Claims, 3 Drawing Sheets

VERTICAL PATH SHEET JAM RECOVERY IMAGE FORMING APPARATUS

CROSS REFERENCE TO RELATED APPLICATIONS

This application claims priority under 35 USC § 119 to Japanese Patent Application Nos. 2001-366524 and 2001-366525 both filed on Nov. 30, 2001, respectively, the entire contents of which are herein incorporated by reference.

BACKGROUND OF THE INVENTION

1. Field of the Invention

The present invention relates to an image forming apparatus for forming an image on a recording medium, and more particularly to an image forming apparatus capable of recovering a sheet jam by releasing a fixing apparatus from a body of the image forming apparatus in conjunction with a sheet conveying apparatus.

2. Discussion of the Background

In an image forming apparatus, such as a copier, printer, facsimile, etc., a type of forming a latent image on a recording medium (herein after referred to as a sheet) and developing the latent image with toner, fixing the toner image, and ejecting the sheet has been widely spread as a known art. In such an image forming apparatus, a tip of the sheet occasionally contacts a member adjacent to a sheet conveying path and is lodged there thereby becoming jammed during its conveyance. This phenomenon is generally called "JAM," and is not absolutely avoidable as far as a sheet is conveyed. In particular, such a jam tends to occur in the vicinity of a fixing section of the image forming apparatus.

Further, an apparatus configured to form an image on both sides of a sheet has been known. In a conventional both sides recordable (i.e., duplex) image forming apparatus, an image (i.e., a visualized image) formed on the image carrier is typically transferred and fixed onto the sheet. Then, the sheet is inverted by an inverting path or the like, and fed again so that the other image (a visualized image) can be transferred onto its rear side and fixed.

In such a duplex recording system, a bifurcation or inversion path necessarily is positioned downstream of a fixing device in a sheet conveying direction and operates after an image is fixed on one side (a first side). For example, a duplex copier disclosed in Japanese Utility Model Application Laid Open No. 5-64174 includes a conveyance path switching lever arranged downstream of a fixing roller in the sheet conveying direction between conveyance and ejection rollers. In addition, an intermediate tray unit is arranged further downstream thereof.

However, such an apparatus that transfers and fixes an image onto a backside of a sheet after inverting the sheet raises problems of credibility due to causing sheet curl after fixation of one side image and a long inversion path. Further, owing to a layout of a bifurcation pick, inverting path located downstream of the fixing apparatus in the sheet conveying direction, and apparatus, such as a conveyance apparatus disposed in an upper side, scanning apparatus, etc., the fixing apparatus can be withdrawn only in a direction perpendicular to a sheet conveyance direction along the sheet plane (i.e., in a direction perpendicular to a sheet plane of FIG. 1 of the above-described publication)

Thus, if a jam that occurred in the fixing apparatus is recovered, and the fixing apparatus is moved in a direction perpendicular to the sheet conveyance direction along the sheet plane, the jam sheet is torn and partially remains due to a relative movement such as lateral deviation of either the ejection or transferring and conveying apparatus from the fixing apparatus.

In view of the above-described problem, the present invention attempts to suppress tearing and a jam sheet partially remaining in a fixing apparatus or other sections when a jam that occurred in a fixing section is to be recovered in a duplex image forming apparatus.

Further, several proposals have been advanced for efficiently recovering a jam with superior operationality. For example, Japanese Patent Application Laid Open No. 2000-44086 refers to a structure in which a motion an upper cover to be open is transmitted to idle, fixing, and ejection rollers collectively serving as a sheet conveyance device by a gear, pinion, and rack collectively serving as a transmission device so as to drive these rollers when a jam occurs, so that a jam sheet is fed and recovered.

Further, Japanese Patent Application Laid Open No. 9-101732 refers to a structure in which an image forming apparatus is divided into two pieces. Specifically, a guide member and guide roller are provided in the first body that houses an image exposure device, sheet feeding section, and fixing apparatus or the like, and is engaged with a plate like member and rotational roller of the second body that houses a photoconductive member, charger, developing device, and cleaning apparatus or similar device. Thus, the Japanese Patent Application Laid Open No. 9-101732 discloses a construction in which an image transfer zone and sheet conveyance surface can be open without an exposure surface of the PC member being exposed by moving the second body arranged upstream in a sheet feeding direction when a jam sheet is to be recovered.

Further, Japanese Patent Application Laid Open No. 2000-198579 refers to a structure in which when a jam occurs in a sheet conveyance path, an operator is urged to confirm a condition of an interior of the fixing apparatus by continuously displaying a jam message until the fixing apparatus is once detached.

However, there exists a type of a jam sheet not fed and recovered when a roller is only driven. For example, when a fixing separation pick sticks into a jam sheet, and the jam sheet is forcibly conveyed, a fixing roller is occasionally damaged and is rendered to be unrecovable. The technology proposed by Japanese Patent Application Laid Open No. 2000-44086 cannot fix such a jam type.

Further, the construction of Japanese Patent Application Laid Open No. 9-101732 can indeed overlook the entire conveyance section. However, Japanese Patent Application Laid Open No. 9-101732 needs a great deal of a withdrawal distance, and the apparatus itself requires a complicated structure. As a result, the cost increases. The continuous jam display of Japanese Patent Application Laid Open No. 2000-198579 is efficient in view of confirmation of a jam sheet. However, it is not directed to an improvement in the operationality of jam recovery.

Further, the conventional duplex copier necessarily includes a sheet-inverting path, which is not opened in conjunction with a body cover at a time of sheet jam.

SUMMARY OF THE INVENTION

The present invention has been made in view of such problems and to address and resolve such problems.

Accordingly, an object of the present invention is to provide a duplex image forming apparatus including a first image carrier configured to carry a first image, and a second image carrier configured to receive the first image. The first image is transferred to one side of a recording medium from the second image carrier, and a second image is formed on the first image carrier and transferred to the other side of the recording medium. Also included is a recording medium conveying device configured to vertically convey the recording medium to a fixing section along a vertical conveyance path at least starting from where the first and second images are transferred onto the recovery medium, and a fixing device included in the fixing section configured to simultaneously fix the first and second images to respective sides of the recording medium. Further, the fixing device is released in conjunction with the recording medium conveying device when the recording medium conveying device is swung and released from the image forming apparatus body such that a portion of the vertical conveyance path extending upstream of the fixing device is opened.

BRIEF DESCRIPTION OF THE DRAWINGS

A more complete appreciation of the present invention and many of the attendant advantages thereof will be readily obtained as the same becomes better understood by the following detailed description when considered in connection with the accompanying drawings, wherein.

DESCRIPTION OF THE PREFERRED EMBODIMENTS

Figure 1:
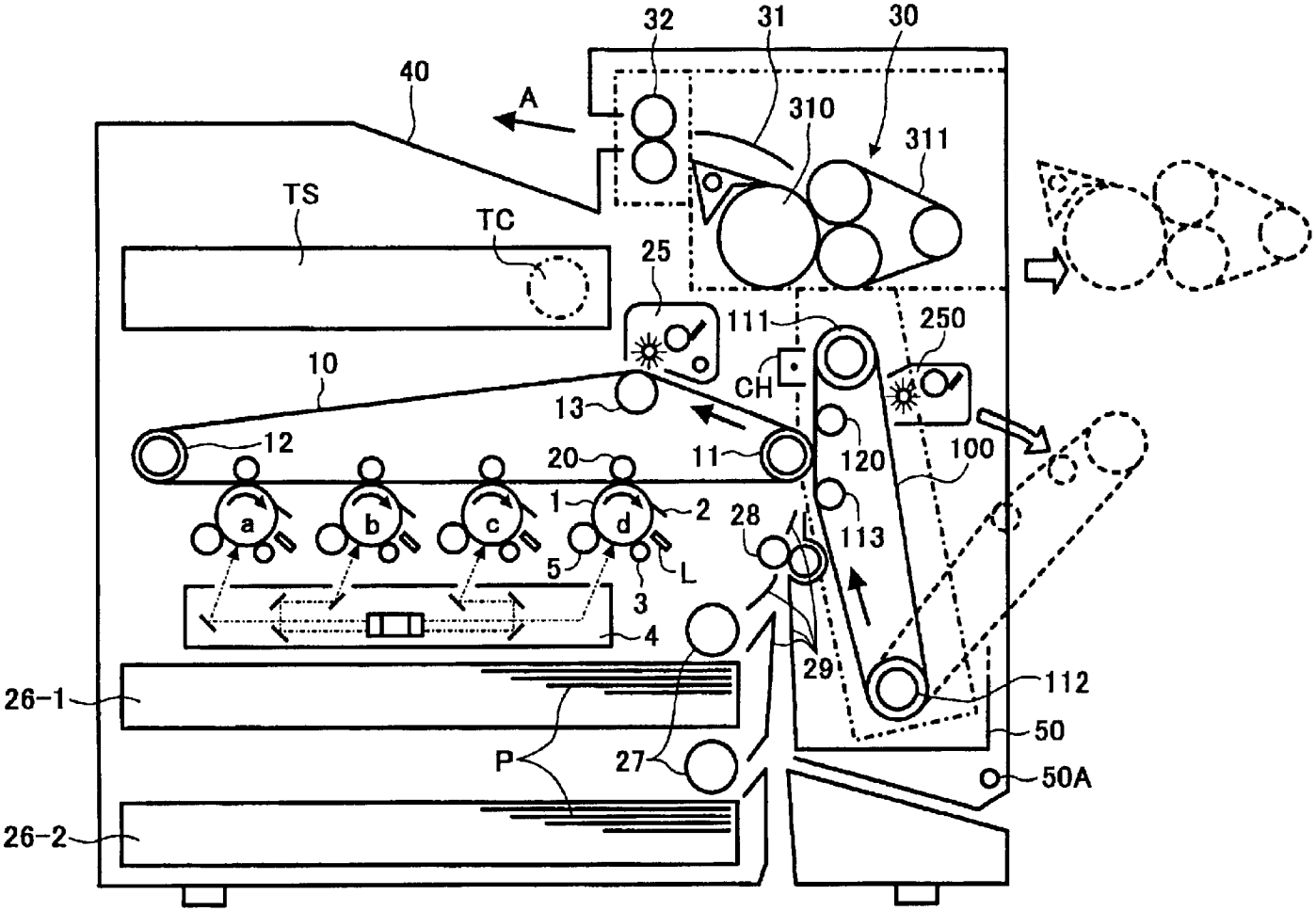
FIG. 1 is a schematic chart illustrating a configuration of a color duplex printer as one example of an image forming apparatus that adopts the present invention.
Figure 2:
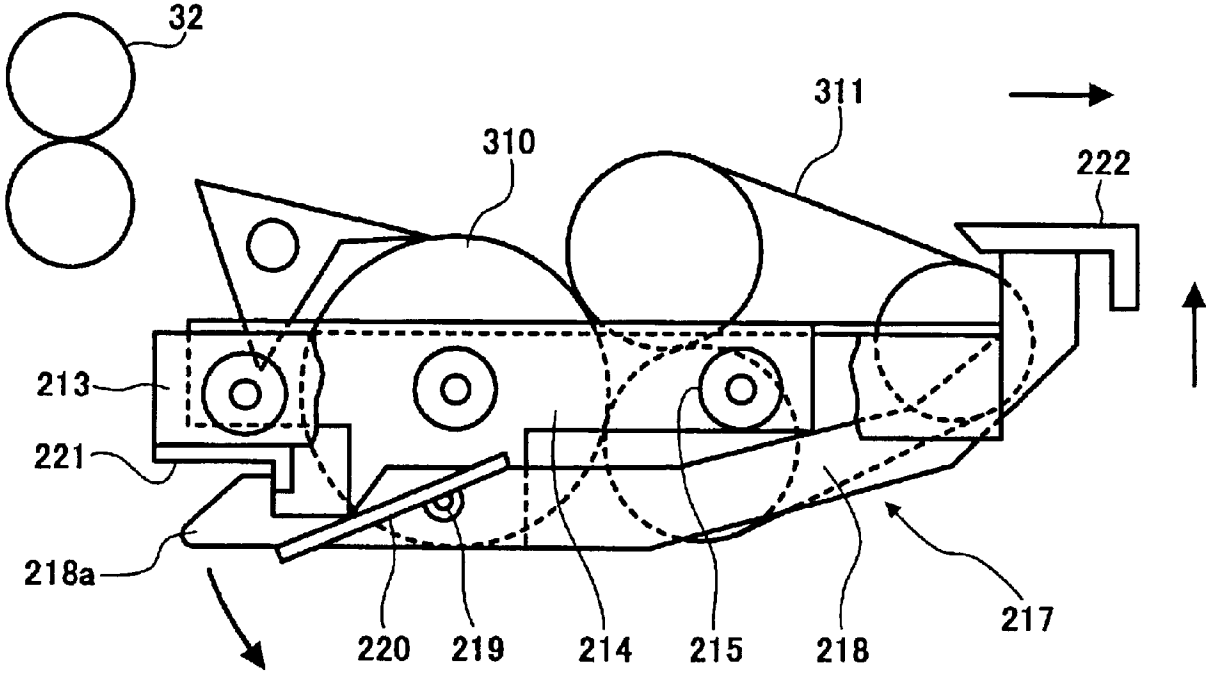
FIG. 2 is a schematic chart illustrating a withdrawal mechanism for a fixing apparatus and sheet ejection unit.

Referring now to the drawings, wherein like reference numerals and marks designate identical or corresponding parts throughout several views, in particular, in FIGS. 1 to 2, the first embodiment of a duplex image forming apparatus adopting a color image forming process using multiple color toner is described according to the present invention.

A mono-color image forming apparatus does not include the below described intermediate transfer belt. However, if a photoconductive member is arranged to directly contact the final belt type image carrier (i.e., the third image carrier in the below described embodiment), the present invention can also be applied thereto.

Each of the charge eliminating, cleaning, discharging, and developing apparatuses L, 2, 3, and 5, respectively, are arranged around the PC member 1 serving as a first image carrier member rotatably supported in a direction shown by an arrow. A space is reserved so as to allow optical information generated from an exposure apparatus 4 to enter between the discharging and developing apparatuses 3 and 5. Four PC members "a" to "d" are provided and are surrounded by the same parts, respectively.

However, a color handled by each of the developing apparatuses 5 is different from each other. The PC member 1 is constructed from an aluminum cylinder having a diameter of from 30 to 100 mm and an organic semiconductor layer of photoconductive substance around its entire surface. The PC member 1 partially contacts an intermediate transfer belt 10 serving as a second image carrier member. For the PC member 1, a belt type can also be employed.

The intermediate transfer belt (a first transfer member) 10 is formed from a plastic film or rubber based belt having a thickness of from 50 to 600 nm and a resistivity capable of transferring toner from the PC member 1. The intermediate transfer belt 10 is laterally long and movably supported and suspended around rotatable rollers 11, 12, and 13 in a direction shown by an arrow. A first transfer device 20 is arranged in the vicinity of the PC member 1 in its backside (i.e., inside a loop).

A cleaning apparatus 25 for the intermediate transfer belt 10 is arranged outside of the belt loop so as to remove unnecessary toner remaining on the intermediate transfer belt 10 after a transfer process.

The exposure apparatus 4 employs a known laser system that irradiates optical information having color resolution corresponding to a color of toner to develop the surface of the PC member 1 uniformly discharged so as to form a latent image. An exposure apparatus formed from an LED array and imaging device can also be used as an alternative.

A backside use transfer member (i.e., a secondary transfer member) 100 serving as a third image carrier member of a belt type is vertically arranged in a right side of the image forming apparatus. Instead of vertically arranging the transfer member 100, it can be alternatively inclined. The backside use transfer member 100 is movably supported in a direction shown by an arrow and is suspended by rotation rollers 111, 112, and 113. A secondary transfer device 120 is arranged in the vicinity of the roller 11 supporting the intermediate transfer belt 10 in the backside thereof (i.e., inside a loop). The secondary transfer member 100 uses a cleaning apparatus 250 and charger CH or the like arranged outside of its belt loop. The cleaning apparatus 250 wipes toner and sheet dust off the surface of the secondary transfer member 100 after toner is transferred onto a sheet.

The primary and secondary transfer members 10 and 100 contact each other by the above-described transfer device 120, the roller 113 and the roller 11 supporting the primary transfer member 10 so as to form a prescribed transfer nip. The secondary transfer member 100 is also formed from a plastic film or rubber based belt having a thickness of from 50 to 600 micron meter, and a prescribed resistivity enabling toner to be transferred from the intermediate transfer belt 10.

The recording medium (i.e., a sheet) P is fed one by one from the upper most sheet stored in sheet feeding apparatuses (i.e., cassettes) 26-1 and 26-2 located in a lower side in the image forming apparatus toward a pair of register rollers 28 via a plurality of guides 29.

A fixing apparatus 30, a sheet ejection guide 31, a pair of sheet ejection rollers 32, and a sheet ejection stack section 40 are arranged in the upper side of the image forming apparatus. The fixing apparatus 30 includes a roller (e.g. a fixing roller 310) having a silicon rubber surface layer substance and housing a heater, a loop like belt (e.g., a pressure belt 311) contacting the fixing roller 310, and a heating member (not shown) disposed in the loop. Another type of a known fixing apparatus may also be used.

A toner containing section TS capable of containing replenishment toner is provided above the intermediate transfer belt 10 and below the sheet ejection section 40. Magenta, cyan, yellow, and black color toner is employed and constitutes a toner cartridge. A powder pump or the like replenishes a prescribed color toner to an applicable developing apparatus.

Because a frame 50 as a part of the body is capable of swinging open around an opening/closing supporting shaft 50A, a sheet conveyance path is able to sufficiently open so as to enable a user to readily recover a sheet jammed in this range.

The fixing apparatus 30 and sheet ejection device (including the sheet ejection guide 31 and roller pair 32) are made into a unit which can be integrally withdrawn rightward in the drawing as shown by a dotted line, so that a sheet jammed on a path starting from the fixing to sheet ejection sections can be readily recovered. An exemplary configuration capable of withdrawing this section is explained with reference to FIG. 2.

As illustrated in FIG. 2, rollers 215 mounted on sliders 214 arranged in a lower side of the unit engage with rails 213 secured to both side plates of the image forming apparatus, respectively. Further, an arm 218 serving as a handle lever 217 is swingably attached in a biased clockwise direction by a torsion spring 220 around a shaft 219 to the lower side of the slider 214. One side tip 218*a* of the arm 218 is formed in a hook shape and is engaged with a stopper 221 disposed on the rail 213. Such a configuration is provided in the other side of the unit. The other side tip of the arm 218 is connected to a lateral beam on which a knob 222 is attached. Accordingly, because the tip 218*a* of the arm 218 disengages the rail 213 with the stopper 221 when the knob 222 is lifted and pulled rightward, the slider 214 moves along the rail via with the roller 215 and the entire unit is withdrawn as a result.

An operation of an image forming apparatus as described above is now described in detail. Referring again to FIG. 1, an operation of forming images on both sides of a sheet is described. An image initially formed when duplex images are formed is herein after referred to as a first side image, and that formed later is referred to as a second side image. A sheet surface to which the first side image is transferred is referred to as a first surface (i.e., a backside surface), and that to which the second side image is transferred is referred to as a second surface (i.e., a front side surface).

An image forming apparatus of this embodiment is a so called printer. A signal for writing is transmitted from a host machine (not shown), such as a PC. The exposure apparatus 4 is driven in accordance with a reception image signal. A light beam irradiated from a LD light source (not shown) of the exposure apparatus 4 reaches one of PC members 1 (e.g., a PC member indicated by "a") uniformly discharged by the discharging apparatus via an optical parts (not shown), and forms a latent image in accordance with writing information (i.e., color).

The developing apparatus 5 develops the latent image, thereby forming a visual image with the toner on the surface of the PC member 1. The toner image on the PC member 1 is transferred to the surface of the intermediate transfer belt 10 synchronously traveling with the PC member 1 by a first transfer device 20. The surface of the PC member 1 is cleaned while the cleaning apparatus 2 removes toner remaining on the transfer belt 10, and is removed from charges such that the PC member 1 is ready for the next image formation cycle.

As shown, the intermediate transfer belt 10 runs counter clockwise while carrying the toner image transferred to its surface, which is be transferred to a first side of a sheet. The other latent image for the other color is written and developed with corresponding color toner, thereby being visualized on a PC member 1*b*. The visualized image is superimposed on the precedent color visual image already lying on the intermediate transfer belt 10. The same process is repeated in each of the PC members 1*c* and 1*d*, thereby superimposing four different colors on the transfer belt 10.

Simultaneously, the intermediate transfer belt 10 is synchronously running with the PC member 1 in a direction shown by an arrow, and an image formed thereon is transferred to a surface of the backside use transfer member 100 by an operation of the second transfer device 120. Because image formation is performed on respective four PC members of so called a tandem type while traveling on both the intermediate transfer belt 10 and the backside transfer member 100, a duration of image formation can be shortened.

When the intermediate transfer belt 10 runs at a prescribed position, a toner image (i.e., a visualized image) to be formed on the other side of the sheet (i.e., a sheet second surface) is formed again on the PC member 1 by executing the above-described steps, and sheet feeding is simultaneously commenced. When the sheet feeding roller 27 rotates counterclockwise, the upper most sheet of either a sheet cassette 26-1 or 26-2 is withdrawn and fed to a pair of register rollers 28. During this time, the toner image (i.e., the first side image) transferred onto the backside use transfer member 100 completes one cycle of rotation when conveyed to contact the intermediate transfer belt 10.

The toner image carried on the surface of the intermediate transfer belt 10 is transferred to one side (first side) of the sheet by the second transfer device 120, when the sheet is conveyed between the intermediate transfer belt 10 and backside use transfer member 100 via the register roller 28. Further, the sheet is fed upward, and the toner image carried on the backside use transfer member 100 is transferred to the other side surface (i.e., a second side) by the charger "CH". When such a transfer process is performed, the sheet is synchronously fed so that a position of an image can be normal.

In this embodiment, a polarity of toner forming an image on a PC member 1 is negative. Thus, a toner image formed on the PC member 1 is transferred to the intermediate transfer belt 10 while a positive electric charge is applied to the first transfer device 20. The toner formed on the intermediate transfer belt 10 is transferred to the backside use transfer member (a third image carrier) 100 while positive electric charge is applied to a second transfer device 120. Further, the toner on the surface of the intermediate transfer belt 10 is transferred to one side surface of the sheet. By applying electric charge having the positive polarity from the charger "CH," the toner having the negative polarity on the backside use transfer member 100 is attracted and transferred to the other side of the sheet.

The sheet P receiving and carrying the toner image on both sides after the above-described process is fed to the fixing apparatus 30 so that these toner images can be fused and fixed at once while passing through the fixing roller 310 and pressure belt 311, while receiving heat and pressure. The sheet P is then ejected onto the ejected sheet stack section 40 arranged on an upper surface of the body frame by the pair of sheet ejection rollers 32 via the pair of guides 31 while being peeled from the fixing rollers 32 by the separation pick (not shown).

If the sheet ejection section 40 is configured as illustrated in FIG. 1, the sheet is stacked thereon while the second side (i.e., a surface (page) receiving transfer from an intermediate transfer belt 10) faces downwardly. Thus, to order the pages, a toner image of a second page is preferably formed in advance to that of a first page and is retained on the backside use transfer member 100. In addition, a toner image of the first page is then formed and is directly transferred to a sheet from the surface of the intermediate transfer belt 10. Accordingly, when sheets are ejected on the sheet ejection section 40 with their faces directing downward in an order of pages, the second side image is the first page.

Images subsequent to the third page are similarly formed and processed. If there exist images on even pages, those images are initially formed and transferred to the backside use transfer member 100. Images of odd pages precedent to the even pages by one are then formed and are transferred directly from the surface of the intermediate transfer belt 10 onto a sheet. Specifically, image formation in this case is performed in an order of 2nd, 1st, 4th, 3rd, 6th, and 5th pages. Controlling of such image formation is performed by a control section (not shown) of the image forming apparatus using a known technology that stores image data in a memory.

Respective exposure are performed on the surface of the PC member 1 such that an image transferred onto the sheet from the intermediate transfer belt 10 is normal, and a toner image transferred onto the sheet from the backside use transfer member 100 is a reversed image (i.e., mirror image). Switching exposure from normal to reversed images is also achieved by a known image processing technology.

After the toner image is transferred to the sheet from the backside use transfer member 100, the cleaning apparatus 250 equipped with a known brush roller, recovery roller, blade or the like removes unnecessary toner and paper dust remaining on the surface of the backside use transfer member. As shown, the brush roller of the cleaning apparatus 250 is separated and engageable with the backside use transfer member 100. That is, the brush roller disengages with the belt type transfer member 100 when the backside use transfer member 100 carries a toner image, and engages with the backside use transfer member 100 when cleaning is performed. The toner removed is then collected into the toner recovery section (not shown).

An operation performed when an image is formed on only one side of a sheet is now described. As understood from the above description of duplex image formation, there are two ways of forming a one side image. One way is using the backside use transfer member 100 and the other is from an intermediate transfer belt. However, the latter is only described, and the process of transferring a toner image onto the backside use transfer member 100 is omitted. Specifically, multiple toner images formed on surfaces of the PC members 1 are transferred onto the intermediate transfer belt 10, and superimposed. Then, the superimposed images are transferred onto a sheet P.

The sheet P is conveyed to a position between the intermediate transfer belt 10 and the backside use transfer member 100 in synchronism with a position of the superimposed images. The second transfer device 120 transfers a toner image onto a surface of the sheet P (i.e., a surface of the intermediate transfer belt side) from the intermediate transfer belt 10.

A charger CH serving as a third transfer device does not operate, and the sheet P travels together with the backside use transfer member 100, and is conveyed to a region equipped with the fixing device 30, so that the superimposed toner images are fixed. In this instance, the sheet P is separated from the backside use transfer member 100 and is ejected via the pair of sheet ejection rollers 32 in a direction shown by the arrow A. The sheet P is then stacked on the ejection sheet stack section 40 with its image surface facing downwardly. According to such a construction, even if original documents of several pages are processed in order from the first page, the printed matter is the page order when the pages are extracted from the sheet ejection stack section 40. At that time, the image formation order is from 1 to 6.

The above-described embodiment is directed to a color image formation using a plurality of color toners. However, the technical concept is also applicable to monochrome image formation.

Figure 3A:
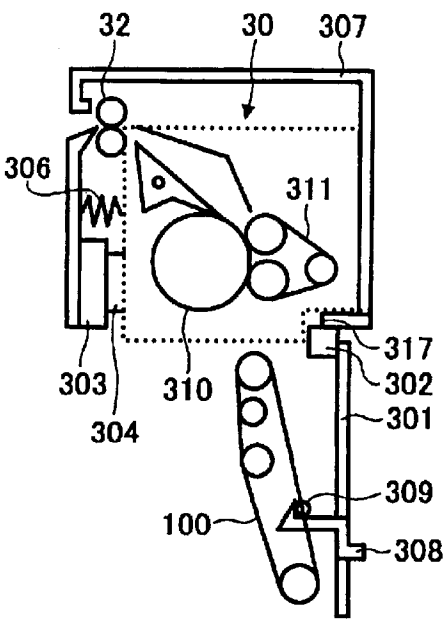
FIGS. 3A, 3B, and 3C are schematic charts each illustrating a releasing mechanism of a fixing apparatus and backside use transfer member, and shows an opening of a sheet conveyance path as time elapses.
Figure 3B:
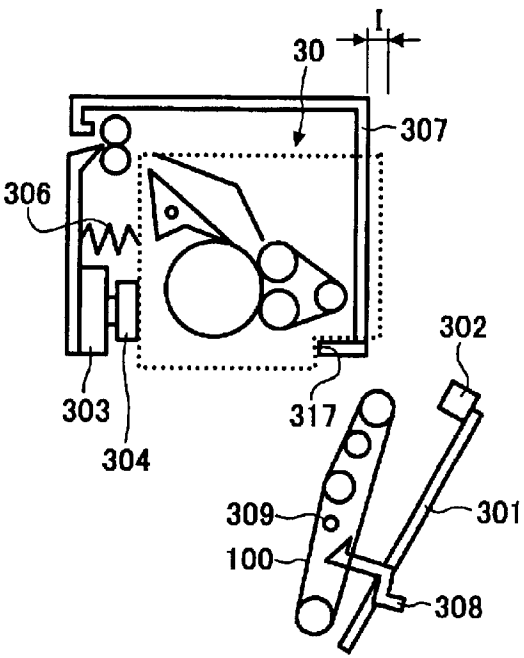

Next, the second embodiment is described with reference to FIGS. 3A to 3C. As shown in FIG. 3A, a secondary transfer member cover 301 is closed when a rock lever 308 is engaged with a body side pin 309 so as to cover the backside use transfer member 100 integrally formed with the secondary transfer member cover 301 in a closed condition. The fixing apparatus 30 is pushed and set by a stopper 302 secured to the secondary transfer member cover 301. In such a condition, the fixing apparatus 30 and backside use transfer member 100 are electrically connected to each other by an alternating current connecter 303 provided in the body side and a connecter 304 correspondingly provided in the fixing apparatus side.

When a jam occurs in a sheet path ranging from the backside use transfer member 100 to the sheet ejection use roller 32 via the fixing apparatus 30, image formation and sheet conveyance are interrupted and alarm messages are displayed on an operation panel (not shown) so as to prompt a user to recover the jammed sheet (jam recovery).

During jam recovery, when the lock lever 308 is lifted and swung, the lock lever 308 disengages with the body side pin 309. The secondary cover 301 then swings open. Thus, jam recovery can be performed from the backside use transfer member 100. Simultaneously, the fixing apparatus 30 is thrust to a striking section 317 of a body frame 307 by a compression spring 306, because the stopper 302 moves together with the second transfer member cover 301. In this situation, a movement distance "I" (see FIG. 3B) should enable the alternating current connecters 303 and 304 to be electrically disconnected to each other, and so that the user recognizes the fixing apparatus 30 is opened. This is preferably only a sufficiently small distances so as to prevent someone from inserting their fingers. However, because the fixing apparatus 30 is above the lock lever 308, the opening is prominent and can be readily recognized.

Figure 3C:
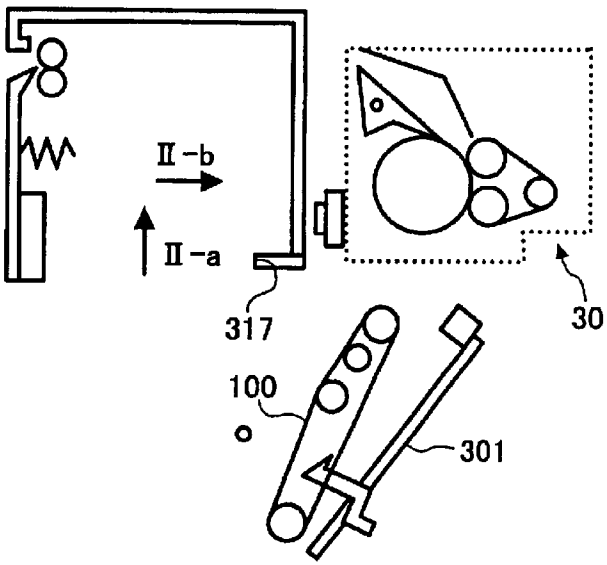

Thus, when jam recovery is to be performed from the fixing apparatus 30, the fixing apparatus 30 is withdrawn as illustrated in FIG. 3C. As shown, the fixing apparatus 30 is first lifted in a direction II-a and then withdrawn in a lateral direction II-b, of the body. Because the withdrawal direction is substantially the same to that of the secondary transfer member cover 301 and the backside use transfer member 100, the user can have a bird's eye view of substantially the entire conveyance path. As a result, jam recovery is easily performed.

Obviously numerous additional modifications and variations of the present invention are possible in light of the above teachings. It is therefore to be understood that within the scope of the appended claims, the present invention may be practiced otherwise than as specifically described herein.

What is claimed is:

1. A duplex image forming apparatus, comprising:

a first image carrier configured to carry a first image;

a second image carrier configured to receive the first image, said first image being transferred to one side of a recording medium from the second image carrier, and a second image being formed on the first image carrier and transferred to the other side of the recording medium;

a recording medium conveying device configured to vertically convey the recording medium to a fixing section along a vertical conveyance path at least starting from where the first and second images are transferred onto the recording medium; and a fixing device included in the fixing section and configured to simultaneously fix the first and second images to respective sides of the recording medium, wherein the fixing device is released in conjunction with the recording medium conveying device when the recording medium conveying device is swung and released from the image forming apparatus body such that a portion of the vertical conveyance path extending upstream of the fixing device is opened.

2. The duplex image forming apparatus according to claim 1, further comprising a releasing lever configured to open the portion of the vertical conveyance path.

3. The duplex image forming apparatus according to claim 2, wherein said conjunctive releasing of the fixing device is achieved by uncompression of an elastic force.

4. The duplex image forming apparatus according to claim 2, wherein the recording medium conveying device and the fixing device are positioned above the releasing lever, and wherein releasing directions of the recording medium conveying device and the fixing device are the same.

5. The duplex image forming apparatus according to claim 1, wherein the fixing device is movable in a direction perpendicular to a recording medium conveyance direction and a surface of the recording medium.

6. The duplex image forming apparatus according to claim 5, wherein said direction is substantially horizontal.

7. The duplex image forming apparatus according to claim 1, further comprising a sheet ejection device arranged downstream of the fixing device, and wherein the fixing device is movable together with the sheet ejection device.

8. A duplex image forming apparatus, comprising:

first image carrier means for carrying a first image;

second image carrier means for receiving the first image, said first image being transferred to one side of a recording medium from the second image carrier means and a second image being formed on the first image carrier means and transferred to the other side of the recording medium;

recording medium conveying means for vertically conveying the recording medium to a fixing section along a vertical conveyance path at least starting from where the first and second images are transferred onto the recording medium; and fixing means included in the fixing section and configured to simultaneously fix the first and second images to respective sides of the recording medium, wherein the fixing means is released in conjunction with the recording medium conveying means when the recording medium conveying means is swung and released from the image forming apparatus body such that a portion of the vertical conveyance path extending upstream of the fixing means is opened.

9. The duplex image forming apparatus according to claim 8, further comprising releasing means for opening the portion of the vertical conveyance path.

10. The duplex image forming apparatus according to claim 9, wherein said conjunctive releasing of the fixing means is achieved by uncompression of an elastic force.

11. The duplex image forming apparatus according to claim 9, wherein the recording medium conveying means and the fixing means are positioned above the releasing means, and wherein releasing directions of the recording medium conveying means and the fixing means are the same.

12. The duplex image forming apparatus according to claim 8, wherein the fixing means is movable in a direction perpendicular to a recording medium conveyance direction and a surface of the recording medium.

13. The duplex image forming apparatus according to claim 12, wherein said direction is substantially horizontal.

14. The duplex image forming apparatus according to claim 8, further comprising sheet ejection means arranged downstream of the fixing means, and wherein the fixing means is movable together with the sheet ejection means.

* * * * *